US005463380A

United States Patent [19]

Matai

[11] Patent Number: 5,463,380

[45] Date of Patent: Oct. 31, 1995

[54] PAGING RECEIVER HAVING A SPEAKER AND AN LED ALTERNATIVELY DRIVEN ON RECEIVING A CALL

[75] Inventor: Masahiro Matai, Tokyo, Japan

[73] Assignee: NEC Corporation, Tokyo, Japan

[21] Appl. No.: 161,091

[22] Filed: Dec. 3, 1993

Related U.S. Application Data

[63] Continuation of Ser. No. 734,660, Jul. 23, 1991, abandoned.

[30] Foreign Application Priority Data

Jul. 23, 1990 [JP] Japan ..... 2-193139

[51] Int. Cl.[6] ..... G08B 5/22

[52] U.S. Cl. ..... 340/825.44; 340/309.4; 340/326; 340/581; 340/636; 455/343

[58] Field of Search ..... 340/825.44, 825.46, 340/825.47, 825.48, 309.4, 581, 311.1, 326, 329, 331, 636; 455/343, 228

[56] References Cited

U.S. PATENT DOCUMENTS

| | | | |
|---|---|---|---|
| 4,499,453 | 2/1985 | Right | 340/331 |
| 4,704,608 | 11/1987 | Sato et al. . | |
| 4,755,816 | 7/1988 | DeLuca | 340/825.44 |
| 4,868,561 | 9/1989 | Davis | 340/825.44 |
| 4,918,438 | 4/1990 | Yamasaki | 340/825.44 |
| 4,924,208 | 5/1990 | Coughlin | 340/457 |
| 4,955,080 | 9/1990 | Wagai et al. | 340/825.44 |
| 4,975,693 | 12/1990 | Davis et al. | 340/825.44 |

FOREIGN PATENT DOCUMENTS

| | | | |
|---|---|---|---|
| 2113666 | 2/1985 | United Kingdom | 340/825.44 |

*Primary Examiner*—John K. Peng
*Assistant Examiner*—Andrew Hill
*Attorney, Agent, or Firm*—Sughrue, Mion, Zinn, Macpeak & Seas

[57] ABSTRACT

A paging receiver having alerting means implemented as a speaker and a light emitting diode (LED). The paging receiver has a decoder for outputting a pair of periodically varying drive signals on determining that a call meant for the receiver has been received, a speaker drive for causing a speaker to sound in the pattern of either one of two drive pattern signals, and an LED driver for turning on the LED in the other pattern. The drive periods of the two drive pattern signals are arranged alternately with each other and such that they do not overlap each other, whereby the luminance of the LED is maintained at a sufficiently high level even when a battery powering the paging receiver reaches the last stage of its service life.

7 Claims, 4 Drawing Sheets

PAGING RECEIVER HAVING A SPEAKER AND AN LED ALTERNATIVELY DRIVEN ON RECEIVING A CALL

This is a continuation of U.S. application Ser. No. 07/734,660 filed Jul. 23, 1991, abandoned.

BACKGROUND OF THE INVENTION

The present invention relates to a paging receiver and, more particularly, to a paging receiver having alert means implemented as a speaker or similar current driven alert means and a light emitting diode (LED).

It is a common practice with a paging receiver to alert the user thereof to a call by the sounding of a speaker and the flashing of an LED. Usually, such alert means are driven by a battery incorporated in the paging receiver and having an open circuit voltage of about 1.5 volts (hereinafter referred to as a 1 volt group battery).

The paging receiver has a receiver section for receiving and demodulating a radio frequency (RF) signal, a ROM (Read Only Memory) storing a paging number assigned to the receiver, and a decoder for comparing a paging number included in the demodulated output of the receiver section with the content of the ROM and, if the former is identical with the latter, producing a drive pattern signal which has an intermittent pattern. The paging receiver causes the speaker to sound intermittently and the LED to flash, both in the pattern of the drive pattern signal, thereby alerting the user to the reception of a call.

Since a voltage of about 1.7 volts is necessary for the LED to turn on, the output voltage of the 1 volt group battery does not suffice. For this reason, a paging receiver of the type using a 1 volt group battery has a boosting circuit for LED drive.

The currents needed to drive the speaker and LED are respectively about 60 milliamperes and about 10 milliamperes although they slightly change due to the drop of the battery voltage. These drive currents assume a considerable proportion of the entire current necessary for the various components of the paging receiver to be driven. Therefore, the voltage of the battery noticeably drops while the speaker sounds and the LED flashes.

The battery for powering a paging receiver is generally implemented by a coin type battery such as a nickel-cadmium battery or an air-zinc battery since this type of battery is small size. The current capacity of such a battery is so small that the above-mentioned voltage drop is considerable, especially when ambient temperature is low.

On the other hand, a conventional paging receiver drives the speaker and LED by drive currents having an identical signal pattern, i.e., drives them at the same time. This aggravates the voltage drop of the battery since the speaker and LED each needs a great drive current, as stated earlier. As a result, at the final stage of the life of the battery or in a low temperature condition, a drive current great enough to insure the luminance of the LED is not achievable.

SUMMARY OF THE INVENTION

It is therefore an object of the present invention to provide a paging receiver of the type having a speaker or similar current driven alerting means and an LED as alerting means and capable of reducing the voltage drop of a battery when the LED turns on to thereby allow the LED to emit light stably with sufficient luminance.

In accordance with the present invention, there is provided a paging receiver of the type having a speaker or similar current driven alerting means and an LED as alerting means and allowing the LED to emit stably with sufficient luminance.

In a preferred embodiment of the present invention, a paging receiver has a receiver section for receiving and demodulating an RF signal. When the demodulated signal includes data identical with a paging number assigned to the paging receiver, a decoder generates a pair of drive signals each including a periodic signal pattern. These two drive signals are so arranged as not to overlap each other with respect to time, preferably alternately with each other. The current driven alerting means is driven by one of the pair of drive signals while the LED is driven by the other drive signal, i.e., the two alerting means are not driven at the same time. This reduces the load on a battery and prevents the voltage drop of the same from occurring in the event when the alerting means are driven. To further enhance the prevention of voltage drop, the signal patterns of the pair of drive signals may be changed in amplitude to opposite polarities to each other. Such an effect will be most significant when the current driven alerting means is comprised of a speaker which needs a great drive current.

In an alternative embodiment of the present invention, a paging receiver has a voltage detecting circuit for producing a voltage detection signal when the output voltage of a battery is higher than a predetermined value, and a signal holding circuit for holding the voltage detection signal appearing just before drive pattern signals begin to appear. A decoder generates two drive pattern signals which are opposite in polarity to each other. While the signal holding circuit outputs the voltage detection signal, the decoder inverts the polarity of one of a pair of drive signals. In this configuration, when the output voltage of the battery just before the pair of drive signals appear is higher than a predetermined value, both of the current driven alerting means and LED are driven at the same time. When the above-mentioned battery output voltage is lower than the predetermined value, the current driven alerting means and the LED are driven at different timings.

In another alternative embodiment of the present invention, a paging receiver has a temperature detecting circuit for outputting a temperature detection signal when ambient temperature is higher than a predetermined value. A decoder outputs drive signals having a pair of signal patterns as signals which are opposite in polarity to each other. While the temperature detecting circuit outputs the temperature detection signal, the decoder inverts the polarity of one of the pair of drive signals. When ambient temperature is higher than a predetermined value, the paging receiver drives the current driven alerting means LED at the same time. When ambient temperature is lower than the predetermined value and the voltage drop of a battery is noticeable, the paging receiver drive them at different timings.

In another alternative embodiment of the present invention, a paging receiver has a voltage detecting circuit, a signal holding circuit, and a temperature detecting circuit. A decoder outputs drive signals having a pair of signal patterns as signals which are opposite in polarity to each other. When the outputs of the signal holding circuit and temperature detecting circuit indicate that the battery output voltage and ambient temperature just before the appearance of the pair of drive signals are higher than their predetermined values, the decoder inverts the polarity of one of the pair of drive signals. In this configuration, when the battery output voltage and ambient temperature just before the appearance of the pair of drive pattern signals are higher than their predetermined values, the current driven alerting means and LED are driven at the same time; if otherwise, they are driven at different timings.

BRIEF DESCRIPTION OF THE DRAWINGS

The above-mentioned and other objects, features and advantages of the present invention will become more apparent by reference to the following detailed description of the invention taken in conjunction with the accompanying drawings, wherein.

DETAILED DESCRIPTION OF THE PREFERRED EMBODIMENTS

Figure 1:
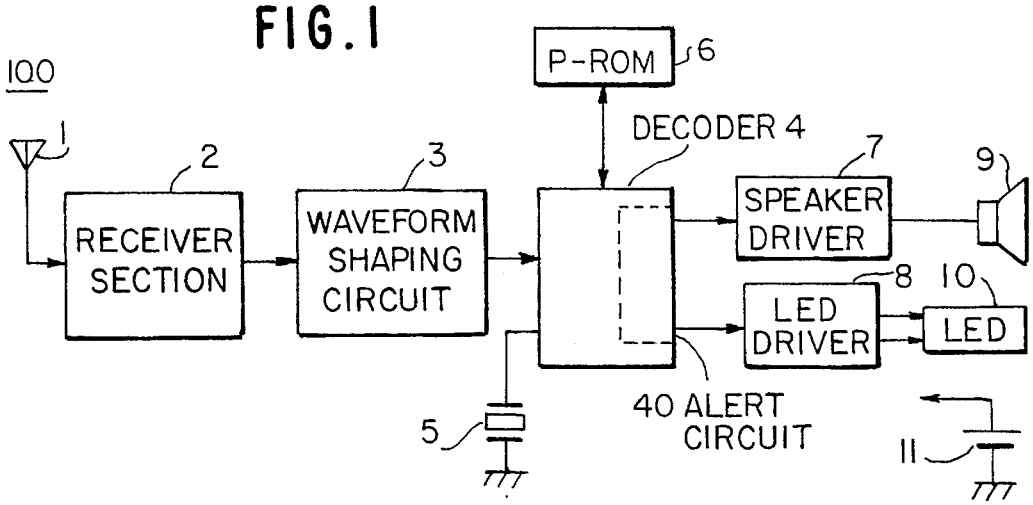
FIG. 1 is a block diagram schematically showing a paging receiver embodying the present invention.

Referring to FIG. 1 of the drawings, a paging receiver embodying the present invention is shown and generally designated by the reference numeral 100. As shown, the paging receiver 100 has an antenna, a speaker 9 which is a specific form of current driven alert means, and an LED 10.

An RF signal coming in through the antenna 1 is amplified and demodulated by a receiver section 2 and then converted to a digital signal by a waveform shaping circuit 3. A decoder 4 generates a reference clock by a crystal resonator 5. In synchronism with the digital signal from the waveform shaping circuit 3, the decoder 4 compares a paging number included in the digital signal with a paging number assigned to the receiver and stored in a P-ROM (Programmable—Read Only Memory) 6 beforehand. If the two paging numbers are identical, the decoder 4 feeds a signal to each of a speaker driver 7 and an LED driver 8 to alert the user of the receiver 100 to the reception of a call. The drive signal fed to the speaker driver 7 is an intermittent signal having a predetermined period and an audible frequency of, for example, 2.7 kilohertz. The speaker driver 7 is an amplifier for amplifying the output signal of the decoder 4 and then delivering it to the speaker 9, so that the speaker 9 produces intermittent sound having the above-mentioned period. On the other hand, the signal fed to the LED driver 8 is an intermittent signal opposite in polarity to the signal to the speaker driver 7 and having a frequency of, for example, 16 kilohertz. The LED driver 8 boosts the voltage fed thereto from a battery 11, i.e., it generates a signal of 16 kilohertz and higher in voltage than the output of the battery 11 by using the signal from the driver 4. The boosted output of the LED driver 8 is applied to the LED 10. As a result, the LED 10 flashes in a pattern opposite to the sounding pattern of the speaker 9. The battery 11 is implemented as a 1 volt group battery and powers the entire paging receiver 100. In the paging receiver 100, the sounding pattern of the speaker 9 and the flashing pattern of the LED 10 are opposite in phase to each other, so that the speaker 9 and the LED 10 are prevented from being driven at the same time.

Figure 2:
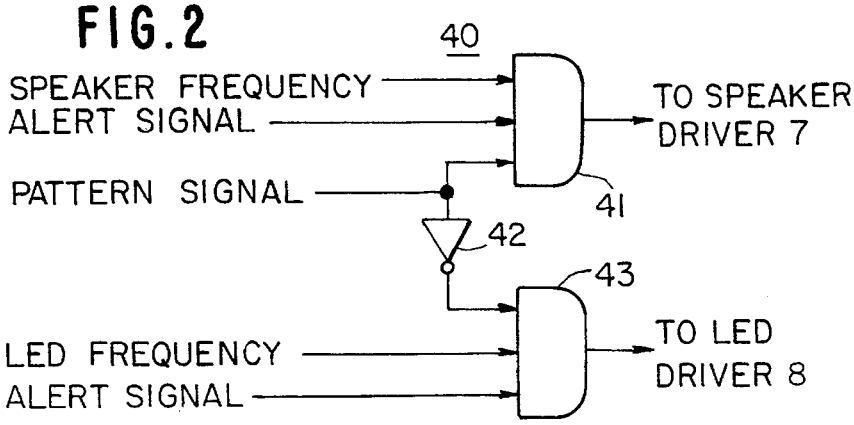
FIG. 2 is a block diagram schematically showing an alert circuit included in the embodiment.
Figure 3:
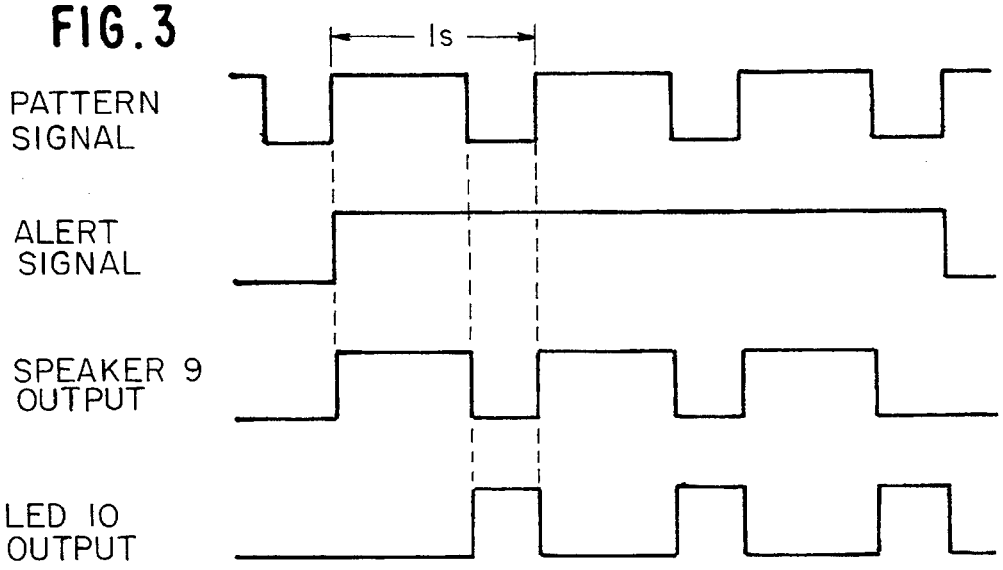
FIG. 3 is a timing chart representative of a specific alerting operation of the embodiment.

Referring also to FIG. 2, the decoder 4 includes an alert circuit 40 which is connected to the speaker driver 7 and LED driver 8. As shown in FIG. 3, the decoder 4 continuously generates a pattern signal representative of an intermittent pattern whose period is 1 second, for example, a speaker frequency signal whose frequency is 2.7 kilohertz, and an LED frequency signal whose frequency is 16 kilohertz. These signals from the decoder 4 are applied to the alert circuit 40. Further, when the paging number included in the digital signal from the waveform shaping circuit 3 is identical with the paging number assigned to the paging receiver 100, the decoder 4 generates an alert signal and feeds it to the alert circuit 4.

The alert circuit 40 has an AND gate 41 to which the speaker frequency signal, alert signal and pattern signal are applied, an inverter 42 to which the pattern signal is inputted, and an AND gate 43 to which the output of the inverter 42, LED frequency signal and alert signal are applied. The output of the AND gate 41 is connected to the speaker driver 7. As the decoder 4 generates the alert signal and feeds it to the AND gates 41 and 43 in response to a call, the AND gate 41 intermittently sends the speaker frequency signal to the speaker driver 7 in the pattern of the pattern signal. At the same time, the AND gate 43 intermittently sends the LED frequency signal to the LED driver 8 in the pattern opposite in phase to the pattern signal. The speaker driver 7 causes the speaker 9 to sound at the frequency of 2.7 kilohertz in the same pattern as the intermittent speaker frequency signal. Likewise, the LED driver 8 causes the LED 10 to flash in the same pattern as the intermittent pattern of the LED frequency signal. As a result, the sounding pattern of the speaker 9 and the flashing pattern of the LED 10 are opposite to each other, as shown in FIG. 3.

Figure 4:
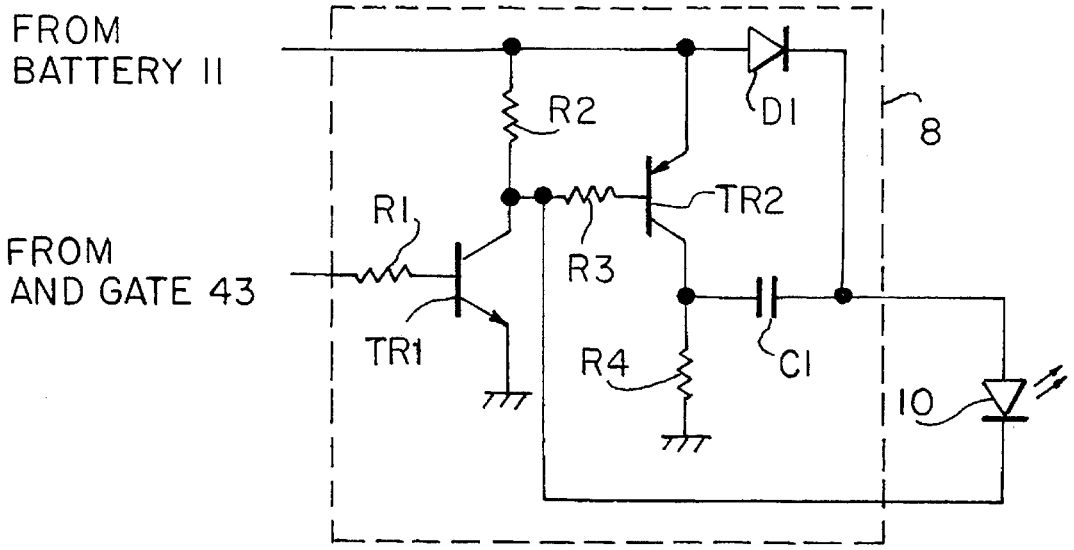
FIG. 4 is a block diagram schematically showing an LED driver also included in the embodiment.

As shown in FIG. 4, the LED driver 8 has an n-p-n transistor TR1 having a collector connected to the battery 11 via a resistor R2 and an emitter connected to ground. The collector of the transistor TR1 is also connected to the base of a p-n-p transistor TR2 via a resistor R3. The transistor TR2 has an emitter connected to the battery 11 and the positive electrode of a diode D1 and a collector connected to ground via a resistor R4 and to the negative electrode of the diode D1 via a capacitor C1. Referring also to FIGS. 1 and 2, the base of the transistor TR1 is connected to the output of the AND gate 43 of the alert circuit 40 via a resistor R1, while the collector of the same is also connected to the negative electrode of the LED 10. The negative electrode of the diode D1 is connected to the positive electrode of the LED 10. As the intermittent LED frequency signal is fed from the AND gate 43 to the base of the transistor TR1 on the arrival of a call, the transistor TR1 is repetitively turned on and off at the frequency of 10 kilohertz so long as the LED frequency signal appears. The transistor TR2 is turned on when the transistor TR1 is turned on and is turned off when the latter is turned off. While the transistors TR1 and TR2 are turned-off, the capacitor C1 is charged up to the output voltage of the battery 11 via the diode D1 and resistor R4. At this instant, the LED 10 does not turn on since the collector voltage of the transistor TR1 is also identical with the output voltage of the battery 11. Subsequently, when the transistors TR1 and TR2 are turned on, the collector voltage of the transistor TR2 is increased to the output voltage of the battery 11 while the collector voltage of the transistor TR1 is reduced to zero volt. As a result, a voltage which is the sum of the voltage across the charged capacitor C1 and the output voltage of the battery 11 is applied to the LED 10, causing the LED 10 to flash. While the LED 10 repetitively flashes at the frequency of 16 kilohertz, it appears to be continuously turned on to the eye due to the afterimage effect. More specifically, as shown in FIG. 3, the LED 10 appears as if it flashed intermittently at a period of 1 second.

Figure 5:
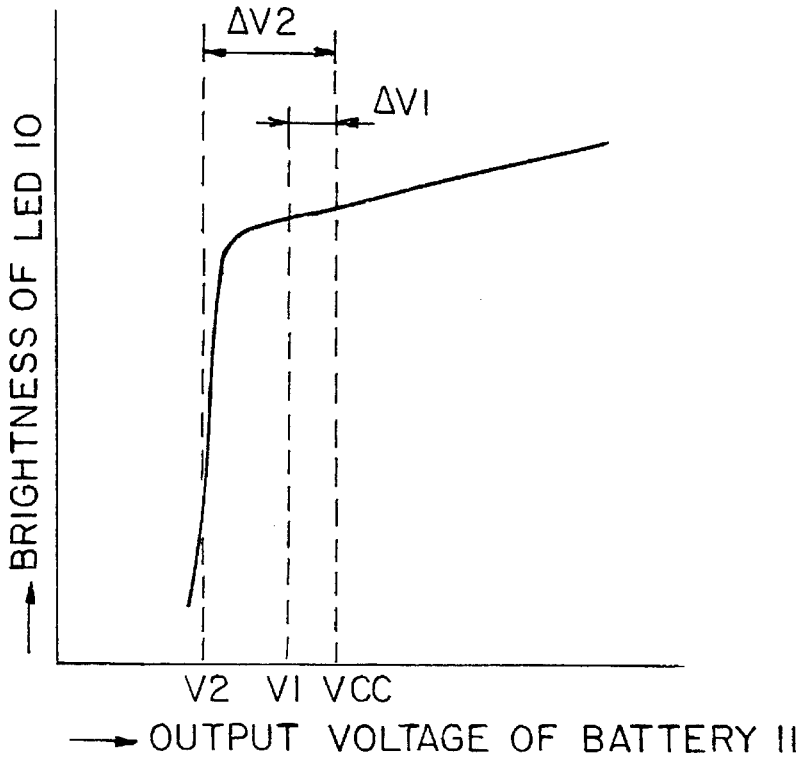
FIG. 5 is a graph indicative of a relative between the luminance of an LED included in the embodiment and the output voltage of a battery.

FIG. 5 shows a specific relation between the luminance of the LED 10 and the output voltage of the battery 11. Assume that the output voltage of the battery 11 is Vcc when a call is not received, i.e., none of the speaker 9 and LED 10 is driven. On the reception of a call, the speaker 9 and LED 10 are alternatively driven with the result that the output current of the battery 11 increases. Consequently, the output voltage of the battery 11 becomes lower than Vcc due to the increase in the voltage drop of the battery 11. Nevertheless, since the speaker 9 and LED 10 are not driven at the same time, the voltage drop of the battery 11 is slower than in the conventional paging receiver which drives both of the speaker 9 and LED 10 at the same time. Specifically, since the drive of the LED 10 and that of the speaker 9 increase the output current of the battery 11 only by about 10 milliamperes and about 60 milliamperes, respectively, the increase $\Delta V1$ in the voltage drop of the battery 11 while the LED 10 is flashing is far smaller than the increase $\Delta V2$ particular to the conventional paging receiver. Hence, in the case where the conventional receiver would lower the output voltage of the battery to V2 due to the increase $\Delta V2$ in voltage drop to thereby critically lower the luminance of the LED, the paging receiver 100 maintains the output voltage of the battery 11 at a level V1 far higher than the level V2 and allows the LED 10 to flash stably with a sufficient luminance. In addition, the decrease in the output voltage of the battery 1 while the speaker 9 is sounding is not noticeable, compared to the conventional paging receiver.

The embodiment has been shown and described as preventing the speaker 9 and LED 10 from being driven at the same time by causing the speaker 9 and LED 10 to turn on in opposite patterns in phase. Alternatively, an interval during which none of the speaker 9 and LED 10 turns on may be provided between the sounding period of the speaker 9 and the flashing period of the LED 10.

Figure 6:
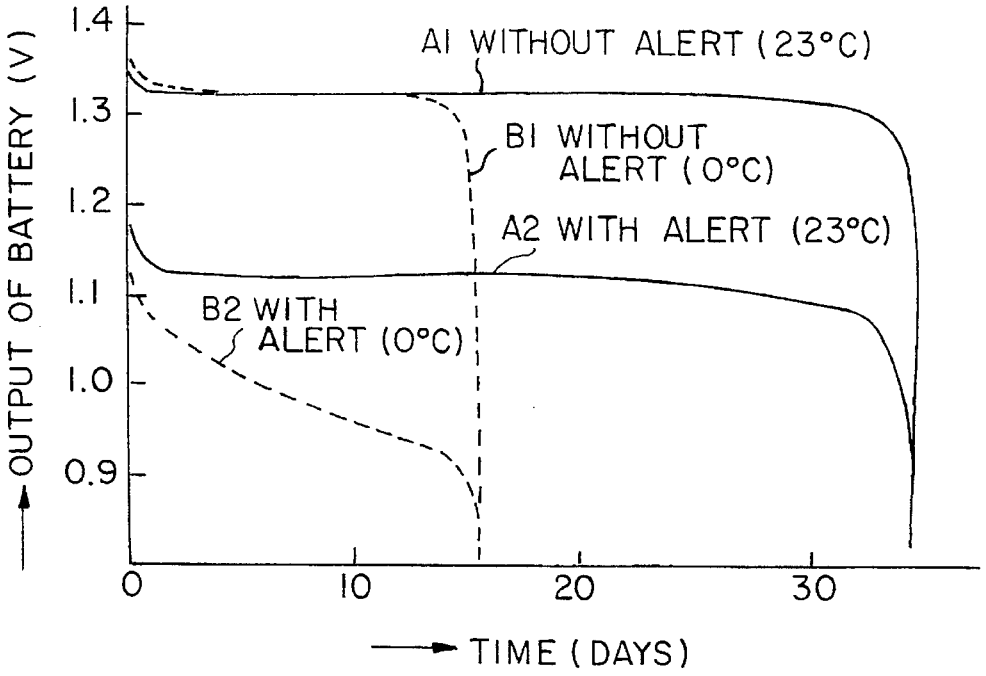
FIG. 6 PRIOR ART
FIG. 6 is a graph showing the discharge characteristic of an air-zinc battery incorporated in a conventional paging receiver.

Referring to FIG. 6, the output voltage to discharge time characteristic of a coin type air-zinc battery is shown on the assumption that the battery is incorporated in a conventional paging receiver. In the figure, curves A1 and A2 show respectively a battery voltage without alert and a battery voltage with alert at normal temperature of 23° C. while curves B1 and B2 show respectively a battery voltage without alert and a battery voltage with alert at 0° C. It will be seen that when ambient temperature is low the battery voltage with alert noticeably drops. It will also be seen that the battery voltage drops at the last stage of the service life of the battery.

Figure 7:
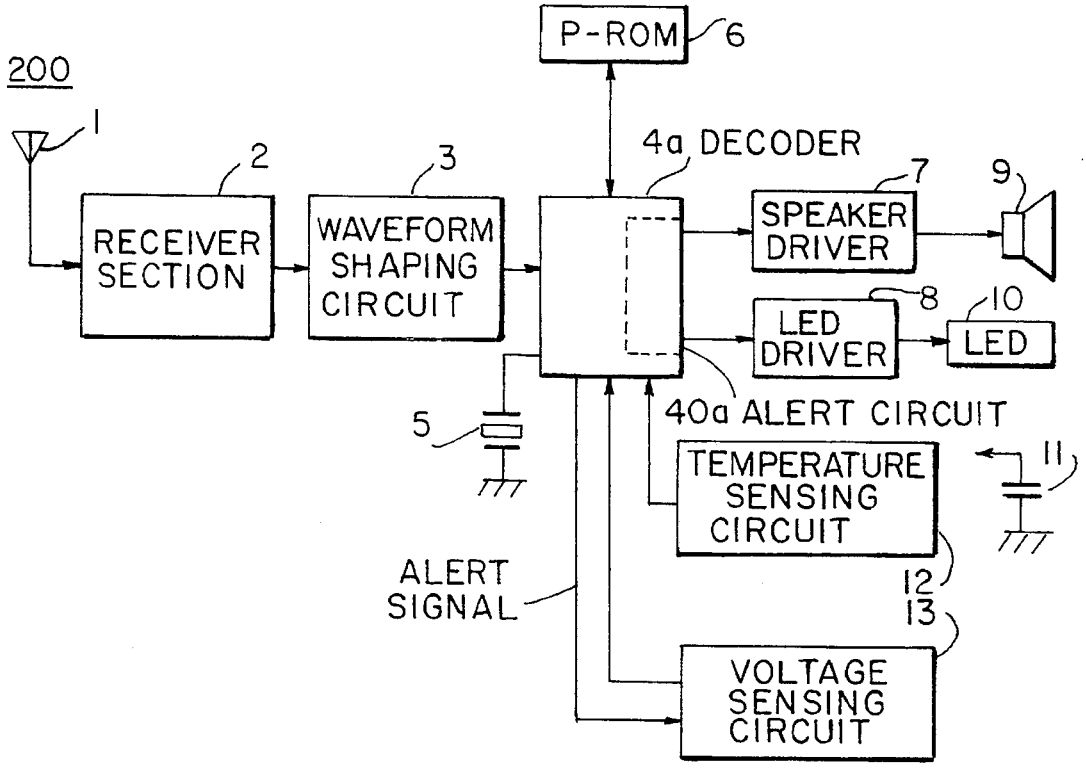
FIG. 7 is a block diagram schematically showing an alternative embodiment of the present invention.

Referring to FIG. 7, an alternative embodiment of the present invention will be described. Briefly, a paging receiver 200 shown in FIG. 7 causes the speaker 9 and LED 10 to turn on in a coincident pattern, as in the conventional paging receiver, only if the voltage of the battery 11 just before the alert is higher than a predetermined level and ambient temperature is higher than a predetermined level. However, when the voltage of the battery 11 is lower than the predetermined level or when ambient temperature is lower than the predetermined level, the paging receiver 200 turns on the speaker 9 and LED 10 in opposite patterns in phase to thereby prevent the luminance of the LED 10 from being noticeably lowered.

Specifically, the paging receiver 200 has a temperature sensing circuit 12 and a voltage sensing circuit 13 in addition to the circuits of the paging receiver 100, FIG. 1. The paging receiver 200 further has a decoder **4*a* in place of the decoder 4 of the paging receiver 100. The decoder 4*a* has an alert circuit 40*a* which is the substitute for the alert circuit 40 of the decoder 4. The temperature sensing circuit 12 outputs a (logical) ONE if ambient temperature is higher than a predetermined temperature To or a (logical) ZERO if otherwise. The output of the temperature sensing circuit 12 is transferred to the decoder 4*a*. The voltage sensing circuit 13 receives the alert signal, FIG. 3, from the decoder 4*a*. The voltage sensing circuit 13 determines whether or not the output voltage of the battery 11 is higher than a predetermined voltage Vo. At the positive-going edge of the alert signal, the voltage sensing circuit 13 holds the result of decision which is a ONE if the battery voltage is higher than the voltage Vo or a ZERO if otherwise, transferring such a result of decision to the decoder 4*a*. Assume that the decoder 4*a* has determined that the paging number included in the digital signal from the waveform shaping circuit 3 is identical with the paging number stored in the P-ROM 6. Then, if both of the outputs of the temperature sensing circuit 12 and voltage sensing circuit 13 are a ONE, the decoder 4*a* feeds a signal of 2.5 kilohertz and a signal of 16 kilohertz which have an identical intermittent drive pattern to the speaker driver 7 and LED driver 8, respectively. However, if at least one of the outputs of the temperature sensing circuit 12 and voltage sensing circuit 13 is a ZERO, the decoder 4*a* sends a signal of 2.7 kilohertz and a signal of 16 kilohertz which are intermittent in opposite drive patterns in polarity to the speaker driver 7 and LED driver 8, respectively. The speaker driver 7 causes the speaker 9 to sound in the same pattern as the intermittent pattern of the signal fed thereto from the decoder 4*a*. Likewise, the LED driver 8 causes the LED 10 to flash in the same pattern as the intermittent pattern of the signal from the decoder 4*a***.

In the above construction, the sounding pattern of the speaker 9 and the flashing pattern of the LED 10 are coincident on condition that ambient temperature is higher than To to prevent the voltage of the battery 11 from being noticeably lowered despite the increase in the output current, and that the voltage of the battery 11 just before alert is higher than Vo to prevent the luminance of the LED 10 from being critically lowered despite the simultaneous drive of the speaker 9 and LED 10. The alert will appear more natural to the user when the sounding pattern of the speaker 9 and the flashing pattern of the LED 10 are coincident than when they are opposite in phase. On the other hand, when ambient temperature is lower than To or when the voltage of the battery 11 is lower than Vo, i.e., when driving the speaker 9 and LED 10 at the same time is apt to noticeably lower the luminance of the LED 10, the sounding pattern of the speaker 9 and the flashing pattern of the LED 10 are opposite in phase to each other. It is easy for the user of the paging receiver 200 to see if the sounding pattern and the flashing pattern are coincident. When the sounding pattern and the flashing pattern are opposite in phase, the user will see that the output of the battery 11 is presumably not high enough to drive the speaker 9 and LED 10 at the same time.

Figure 8:
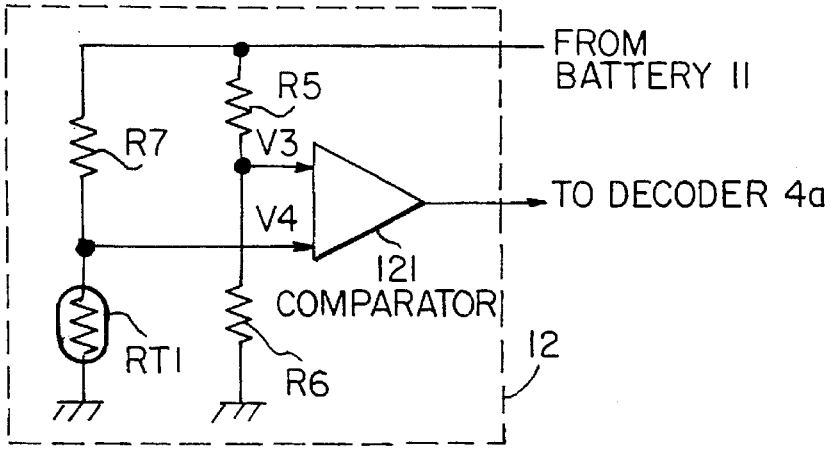
FIG. 8 is a block diagram schematically showing a temperature sensing circuit included in the embodiment of FIG. 7.

As shown in FIG. 8, the temperature sensing circuit 12 has resistors R5 and R7 each being connected at one end to the battery 11. The other end of the resistor R5 is connected to ground via a resistor R6, while the other end of the resistor R7 is connected to ground via a thermistor TR1. The junction of the resistors R5 and R6 and the junction of the resistor R7 and thermistor RT1 are respectively connected to a first input and a second input of a comparator 121. The comparator 121 feeds to the alert circuit 40*a* of the decoder 4*a* a ONE when the input voltage to the first input thereof is higher than the input voltage to the second input or a ZERO when otherwise. Assume that the voltage which the resistors R5 and R6 produce by dividing the voltage of the battery 11 is V3, and the voltage which the resistor R7 and thermistor RT1 produce by dividing the same is V4. The resistances of the resistors R5, R6 and R7 and thermistor RT1 are selected such that the voltages V3 and V4 are equal at a given temperature To lower than normal temperature. The resistance of the thermistor TR1 decreases with the increase in temperature. Hence, when ambient temperature is higher than To, a relation V3>V4 holds and, therefore, the output of the comparator 121 is a ONE. Conversely, when the ambient temperature is lower than To, V3<V4 and, therefore, the output of the comparator 221 is a ZERO.

Figure 9:
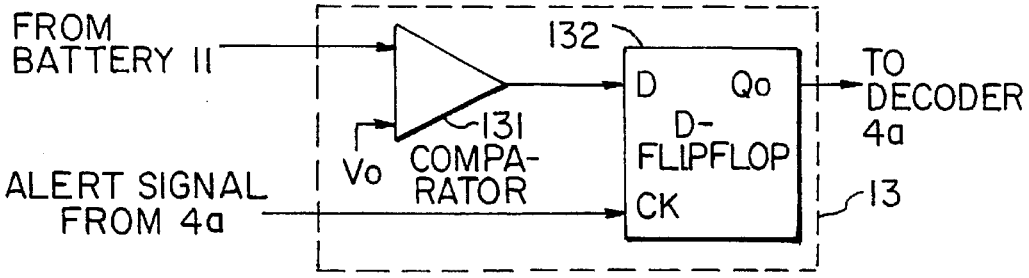
FIG. 9 is a block diagram schematically showing a voltage sensing circuit also included in the embodiment of FIG. 7.

As shown in FIG. 9, the voltage sensing circuit 13 has a comparator 131 connected at one input to the battery 11 and at the other input to a constant voltage Vo. The output of the comparator 131 is connected to the data input terminal D of a D flip-flop 132. The alert signal from the decoder 4*a* is applied to the clock terminal CK of the D flip-flop 132. The output of the flip-flop 132 appearing on the data output terminal Qo is sent to the alert circuit 40*a* of the decoder 4*a*. Assuming that the output voltage of the battery 11 just before an alert is V5, the constant voltage Vo is selected to be the lower limit of the voltage V5 which, if ambient temperature is higher than To, does not critically lower the luminance of the LED 10 even when the speaker 9 and LED 10 are driven at the same time. The comparator 131 produces a ONE if the output voltage of the battery 11 is higher than Vo or a ZERO if otherwise. The D flip-flop 132 holds and outputs the output of the comparator 131 at the positive-going edge of the alert signal. Since the decoder 4*a* produces an alert signal in response to a call, the output of the D flip-flop 132 which is the output of the voltage sensing circuit 13 is a ONE if the output voltage of the battery 11 just before the alert is higher than Vo or a ZERO if otherwise.

Figure 10:
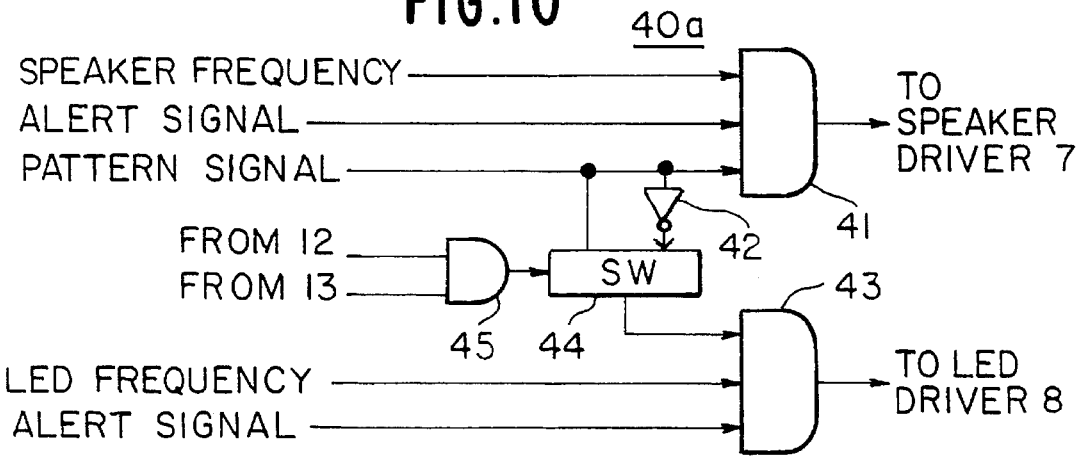
FIG. 10 is a block diagram schematically showing an alert circuit depicted in FIG. 7.

Referring to FIG. 10, the alert circuit 40*a* has a switch 44 and an AND gate 45 in addition to the AND gates 41 and 43 and inverter 42 of the alert circuit 40, FIG. 2. The speaker frequency signal and pattern signal are constantly applied to the AND gate 41. On receiving the alert signal, the AND gate 41 delivers the speaker frequency signal to the speaker driver 7 intermittently in the pattern of the pattern signal. This part of the operation has already been described in relation to the alert circuit 40. The pattern signal is also fed to the inverter 42 and one of two inputs of the switch 44. The other input of the switch 44 is connected the output of the inverter 42. The switch 44 selects either one of the two inputs under the control of the AND gate 45. Applied to the AND gate 45 are the output signals of the temperature sensing circuit 12 and voltage sensing circuit 13. The switch 44 selects the pattern signal if the signal from the AND gate 45 is a ONE or selects the output of the inverter 42 if it is a ZERO. The signal selected by the switch 44 and the LED frequency signal are continuously fed to the AND gate 43. On receiving an alert signal, the AND gate 43 sends the LED frequency signal to the LED driver 8 intermittently in the pattern of the signal selected by the switch 44. When both of the signals from the sensing circuits 12 and 13 which are inputted to the AND gate 45 are a ONE, the switch selects the pattern signal. Hence, the intermittent pattern of the signal fed from the AND gate 41 to the speaker driver 7 and the intermittent pattern of the signal fed from the AND gate 43 to the LED driver 8 are identical. Further, when at least one of the two inputs to the AND gate 45 is a ZERO, the switch 44 selects the output of the inverter 42, i.e., the signal opposite in polarity to the pattern signal. Then, the intermittent pattern from the AND gate 41 and the intermittent pattern from the AND gate 43 are opposite in phase to each other.

In summary, it will be seen that the present invention provides a paging receiver having means for driving, on receiving a call, current driven alert means and an LED alternately and such that their driving periods do not overlap each other. The paging receiver, therefore, reduces the voltage drop of a battery when the LED is turned on and thereby allows the diode to flash stably with high luminance.

Although the invention has been described with reference to the specific embodiments, this description is not meant to e construed, in a limiting sense. Various modifications of the disclosed embodiments, as well as other embodiments of the invention, will become apparent to persons skilled in the art upon reference to the description of the invention. It is therefore contemplated that the appended claims will cover any modifications or embodiments as fall within the true scope of the invention.

What is claimed is:

1. A paging receiver comprising:

first means for receiving a radio frequency (RF) signal to produce a demodulated output;

second means for detecting data representative of a predetermined paging number out of said demodulated output to produce a detection output;

third means responsive to said detection output for generating first and second drive signals during a predetermined period of time, each of said first and second drive signals having an amplitude alternating between high and low levels, the high levels of said first and second drive signals alternating with each other during said predetermined period of time;

first alerting means responsive to said first drive signal for alerting the production of said detection output;

second alerting means responsive to said second drive signal for alerting the production of said detection output; and battery means for feeding source power to said first, second and third means, and said first and second alerting means;

wherein said first and second alerting means substantially concurrently alert the detection of said detection output to a user of said paging receiver during said predetermined period of time;

wherein said first alerting means comprises a light emitting diode (LED) and an LED driver for driving said LED in response to said first drive signal; and wherein said second alerting means comprises a speaker and a speaker driver for driving said speaker in response to said second drive signal;

fourth means for producing a control signal when the output voltage of said battery means is higher than a predetermined level; and inverting means, responsive to said control signal, for inverting the polarity of one of said first and second drive signals to simultaneously drive said first and second alerting means.

2. A paging receiver comprising:

first means for receiving a radio frequency (RF) signal to produce a demodulated output;

second means for detecting data representative of a predetermined paging number out of said demodulated output to produce a detection output;

third means responsive to said detection output for generating first and second drive signals during a predetermined period of time, each of said first and second drive signals having an amplitude alternating between high and low levels, the high levels of said first and second drive signals alternating with each other during said predetermined period of time;

first alerting means responsive to said first drive signal for alerting the production of said detection output;

second alerting means responsive to said second drive signal for alerting the production of said detection output; and battery means for feeding source power to said first second and third means and said first and second alerting means;

wherein said first and second alerting means substantially concurrently alert the detection of said detection output to a user of said paging receiver during said predetermined period of time;

wherein said first alerting means comprises a light emitting diode (LED) and an LED driver for driving said LED in response to said first drive signal; and wherein said second alerting means Comprises a speaker and a speaker driver for driving said speaker in response to said second drive signal;

fourth means for producing a control signal when an ambient temperature is higher than a predetermined value; and fifth means, responsive to said control signal, for inverting the polarity of one of said first and second drive signals to simultaneously drive said first and second alerting means.

3. A paging receiver comprising:

first means for receiving a radio frequency (RF) signal to produce a demodulated output;

second means for detecting data representative of a predetermined paging number out of said demodulated output to produce a detection output;

third means responsive to said detection output for generating first and second drive signals during a predetermined period of time, each of said first and second drive signals having an amplitude alternating between high and low levels, the high levels of said first and second drive signals alternating with each other during said predetermined period of time;

first alerting means responsive to said first drive signal for alerting the production of said detection output;

second alerting means responsive to said second drive signal for alerting the production of said detection output; and battery means for feeding source power to said first, second and third means, and said first and second alerting means;

wherein said first and second alerting means substantially concurrently alert the detection of said detection output to a user of said paging receiver during said predetermined period of time;

wherein said first alerting means comprises a light emitting diode (LED) and an LED driver for driving said LED in response to said first drive signal; and wherein said second alerting means comprises a speaker and a speaker driver for driving said speaker in response to said second drive signal;

fourth means for producing a first control signal when the output voltage of said battery means is higher than a predetermined value;

fifth means for producing a second control signal when ambient temperature is higher than a predetermined value; and sixth means, responsive to said first control signal and said second control signal, for inverting the polarity of one of said first and second drive signals to simultaneously drive said first and second alerting means.

4. A paging receiver comprising:

a receiver section for receiving and demodulating a radio frequency (RF) signal;

a waveform shaping circuit for shaping a waveform of a demodulated output of said receiver section;

a ROM for storing data representative of a predetermined paging number;

a decoder responsive to an output signal of said waveform shaping circuit for reading said data out of said ROM and, outputting a paging number detection signal when said output signal of said waveform shaping circuit includes data identical with said data read out of said ROM, said decoder outputting a paging number detection signal;

means responsive to said paging number detection signal for generating first and second drive signals during a predetermined period of time, each of said first and second drive signals having an amplitude alternating between high and low levels, the high levels of said first and second drive signals alternating with each other during said predetermined period of time;

audible alerting means responsive to said first drive signal for alerting the production of said paging number detection signal;

visible alerting means responsive to said second drive signal for alerting the production of said paging number detection signal; and battery means for feeding source power to said decoder, said audible alerting means and said visible alerting means;

wherein said audible alerting means and said visible alerting means substantially concurrently alert the detection of said predetermined paging number to a user of said paging receiver during said predetermined period of time;

wherein said means responsive to said paging number detection signal comprises:

a first AND gate for receiving said paging number detection signal output by said decoder and a periodic pattern signal and outputting either one of said first and second drive signals;

an inverting circuit to which said periodic pattern signal is applied; and a second AND gate for receiving the output of said inverting circuit and said paging number detection signal output by said decoder and outputting the other drive signal;

a voltage detecting circuit for outputting a first control signal when the output voltage of said battery is higher than a predetermined value;

holding means for holding, on receiving said first control signal from said voltage detecting circuit and said paging number detection signal from said decoder, said first control signal in response to a positive-going edge of said paging number detecting signal; and a switch for inputting, on receiving said first control signal from said holding means, said periodic pattern signal to said second AND gate in place of the output signal of said inverting circuit.

5. A paging receiver as claimed in claim 4, wherein said holding means comprises a D flip-flop clocked by said paging number detection signal.

6. A paging receiver comprising:

a receiver section for receiving and demodulating a radio frequency (RF) signal;

a waveform shaping circuit for shaping a waveform of a demodulated output of said receiver section;

a ROM for storing data representative of a predetermined paging number;

a decoder responsive to an output signal of said waveform shaping circuit for reading said data out of said ROM and, outputting a paging number detection signal when said output signal of said waveform shaping circuit includes data identical with said data read out of said ROM, said decoder outputting a paging number detection signal;

means responsive to said paging number detection signal for generating first and second drive signals during a predetermined period of time, each of said first and second drive signals having an amplitude alternating between high and low levels, the high levels of said first and second drive signals alternating with each other during said predetermined period of time;

audible alerting means responsive to said first drive signal for alerting the production of said paging number detection signal;

visible alerting means responsive to said second drive signal for alerting the production of said paging number detection signal; and battery means for feeding source power to said decoder, said audible alerting meads and said visible alerting means;

wherein said audible alerting means and said visible alerting means substantially concurrently alert the detection of said predetermined paging number to a user of said paging receiver during said predetermine period of time;

wherein said means responsive to said paging number detection signal comprises:

a first AND gate for receiving said paging number detection signal output by said decoder and a periodic pattern signal and outputting either one of said for and second drive signals;

an inverting circuit to which said periodic pattern signal is applied; and a second AND gate for receiving the output of said inverting circuit and said paging number detection signal output by said decoder and outputting the other drive signal;

a temperature detecting circuit for outputting a second control signal when ambient temperature is higher than a predetermined value; and a switch for inputting, on receiving said second control signal from said temperature detecting circuit, said periodic pattern signal to said second AND gate in place of the output signal of said inverting circuit.

7. A paging receiver comprising:

a receiver section for receiving and demodulating a radio frequency (RF) signal;

a waveform shaping circuit for shaping a waveform of a demodulated output of said receiver section;

a ROM for storing data representative of a predetermined paging number;

a decoder responsive to an output signal of said waveform shaping circuit for reading said data out of said ROM and, outputting a paging number detection signal when said output signal of said waveform shaping circuit includes data identical with said data read out of said ROM, said decoder outputting a paging number detection signal;

means responsive to said paging number detection signal for generating first and second drive signals during a predetermined period of time, each of said first and second drive signals having an amplitude alternating between high and low levels, the high levels of said first and second drive signals alternating with each other during said predetermined period of time;

audible alerting means responsive to said first drive signal for alerting the production of said paging number detection signal;

visible alerting means responsive to said second drive signal for alerting the production of said paging number detection signal; and battery means for feeding source power to said decoder, said audible alerting means and said visible alerting means;

wherein said audible alerting means and said visible alerting means substantially concurrently alert the detection of said predetermined paging number to a user of said paging receiver during said predetermined period of time;

wherein said means responsive to said paging number detection signal comprises:

a first AND gate for receiving said paging number detection signal output by said decoder and a periodic pattern signal and outputting either one of said first and second drive signals;

an inverting circuit to which said periodic pattern signal is applied; and a second AND gate for receiving the output of said inverting circuit and said paging number detection signal output by said decoder and outputting the other drive signal;

a voltage detecting circuit for outputting a first control signal when the output voltage of said battery is higher than a predetermined value;

holding means for holding, on receiving said first control signal from said voltage detection circuit and said paging number detection signal from said decoder, said first control signal at a positive-going edge of said paging number detection signal;

a temperature detecting circuit for outputting a second control signal when ambient temperature is higher than a predetermined value;

a third AND gate to which said first control signal from said holding means and said second control signal from said temperature detecting circuit are applied; and a switch for inputting, on receiving the output signal of said third AND gate, said periodic pattern signal to said second AND gate in place of the output signal of said inverting circuit.

* * * * *